US006991135B2

(12) United States Patent
von Schuckmann

(10) Patent No.: US 6,991,135 B2
(45) Date of Patent: Jan. 31, 2006

(54) DISPENSER FOR THE APPORTIONED DELIVERY OF PASTY SUBSTANCES

(76) Inventor: Alfred von Schuckmann, Winnekendonker Str. 52, Kevelaer (DE) D-47627

( * ) Notice: Subject to any disclaimer, the term of this patent is extended or adjusted under 35 U.S.C. 154(b) by 0 days.

(21) Appl. No.: 10/513,838

(22) PCT Filed: May 19, 2003

(86) PCT No.: PCT/EP03/05246

§ 371 (c)(1),
(2), (4) Date: May 19, 2005

(87) PCT Pub. No.: WO03/097486

PCT Pub. Date: Nov. 27, 2003

(65) Prior Publication Data

US 2005/0224521 A1 Oct. 13, 2005

(30) Foreign Application Priority Data

May 21, 2002 (DE) ..... 102 22 356

(51) Int. Cl.
*B67D 5/42* (2006.01)

(52) U.S. Cl. ..... 222/209; 222/260; 222/387

(58) Field of Classification Search ..... 222/209, 222/387, 260
See application file for complete search history.

(56) References Cited

U.S. PATENT DOCUMENTS 4,684,044 A * 8/1987 Foster ..... 222/386
4,978,037 A * 12/1990 Schuckmann ..... 222/260
4,991,744 A * 2/1991 Von Schuckmann ..... 222/256

* cited by examiner

*Primary Examiner*—Philippe Derakshani
(74) *Attorney, Agent, or Firm*—Martin A. Farber

(57) ABSTRACT

Dispenser for delivering portions of pasty substances has a tubular housing with a plunger, an emptying nozzle, a squeeze head, a handle and a stationary cover. The plunger is displaced in the tubular housing in a stepwise manner during emptying actuation in a direction of the emptying nozzle. The nozzle is associated with the squeeze head that can be pressed in the direction of the plunger and can be actuated via the handle. The stationary cover closes an opening cross-section of the emptying nozzle. The handle, upon pressure actuation, pivots about a point which, in relation to the emptying nozzle is located on an opposite side to an actuating-button surface of the handle, and the emptying nozzle pivots away sideways beneath the cover.

10 Claims, 3 Drawing Sheets

K
35
y
27
H
Sp
20
3
19
38
2
18
a
28
26
31
36
30
b
21
13
6
14
13'
9
17
25
24
25
x
7
1
8
1'
10
11
11
12
4
y

DISPENSER FOR THE APPORTIONED DELIVERY OF PASTY SUBSTANCES

FIELD AND BACKGROUND OF THE INVENTION

The invention relates to a dispenser for delivering portions of pasty substances, having a tubular housing in which a plunger is displaced in a stepwise manner, during emptying actuation, in the direction of an emptying nozzle, which is associated with a squeeze head, which can be pressed in in the direction of the plunger and can be actuated via a handle, and is associated with a stationary cover, which closes the opening cross-section of the emptying nozzle.

EP-B1 0 051 790 discloses a squeeze head with this associated emptying nozzle. The handle is an integral constituent part of the squeeze head, to be precise it is formed by a top portion of the same. Upon actuation, the tubular emptying nozzle, coming from an oblique position, moves increasingly into an axis-parallel position in relation to the longitudinal center axis of the dispenser, which in this case also has a tubular housing.

DE-A1 37 16 822 discloses a dispenser of the generic type in which the squeeze head is actuated via a separate handle which is mounted such that it can be pressed in. The actuating force is introduced into the squeeze head via bending portions. The bending portions are of such a length that they compensate for different movement sequences between the handle and the squeeze head. Upon actuation, the opening cross-section of the emptying nozzle lifts up, for all practical purposes, axially from the stationary cover. The cover and opening cross-section are cut obliquely to run in the same direction in a cannula-like manner.

SUMMARY OF THE INVENTION

It is an object of the invention to form a dispenser of the generic type in a functionally advantageous manner.

This object is achieved first and foremost in the case of a dispenser having the features of claim 1, this being based on the fact that the emptying nozzle, upon handle actuation, pivots away sideways beneath the cover.

Such a configuration achieves a functionally advantageous dispenser. The operation of the emptying nozzle being pivoted out via the actuation of the handle results in an excellent free-standing position of the opening cross-section. The transfer of the contents of the dispenser, which are discharged in an extrusion-like manner, to the intended location can thus be effected to be as far possible visible. The squeeze head, which deforms counter to the inherent restoring force, forms, as it were, the emptying-nozzle pivot point. The pivoting-away movement, which takes place in the sideways direction, can expediently be carried out on the relatively hard emptying nozzle. Sideways is intended to mean in the direction of the lateral wall. The opening cross-section is thus not displaced into the less accessible center of the dispenser, as is the case with the generically determinative forerunner. The opening cross-section runs back and forth with excess paste removing action beneath the cover.

The subject matters of the rest of the claims are explained hereinbelow in relation to the subject matter of claim 1, but may also be important in their independent formulation. Thus, the dispenser mechanism is further formed in that the handle, upon pressure actuation, pivots about a point which, in relation to the emptying nozzle, is located on the opposite side to the actuating-button surface, and it has an axially directed tail acting on a drive protrusion of the emptying nozzle. A gear-like function is present, a relatively small pivoting angle being sufficient for the handle. The actuating forces, in addition, are moderate. The actuating/dispenser mechanism is accommodated in a comparatively small space at the top of the dispenser. In respect of the drive protrusion, which can be integrally formed on the emptying nozzle, it is then advantageous if the operating surface of the drive protrusion is configured as a downwardly sloping oblique surface. The angle of slope is approximately 45° in relation to the initial orientation of the tail, which is likewise integrally formed on the handle. With regard to the dispenser configured as a stand-up unit, the tail is initially oriented in the vertical direction. Furthermore, it is provided that the oblique surface ends in a limiting groove. This provides a stop which is very noticeable to the user. In respect of the leverages, it then proves to be advantageous if the free end of the axially directed tail is located approximately level with the pivot point. Moreover, it is a feature of the invention that the lower end of the emptying nozzle is plugged in a flush manner into a neck of the squeeze head. A sealed plug-in connection is ensured, for which purpose the squeeze head usually consisting of elastomeric material is very well suited. A groove/rib engagement can be used in order to arrest the parts securely. In order also for high levels of actuating loading which give rise to displacements between the emptying nozzle and neck to be counteracted in an effective manner, provision is made, in respect of the emptying nozzle, for the bottom edge of the drive protrusion to be supported on the periphery of the neck. This results in the drive protrusion performing a further function. Moreover, a configuration of even independent importance consists in the cover being seated on a half-shell-like surround of an angled portion of the emptying nozzle. That portion of the emptying nozzle which is accommodated in the surround is thus guided to good effect and is also corrected in position, in order that the basic position is always the same, as it re-enters this covering portion. The cover, in addition, has a stiffening effect on the shell-like surround, so that it is possible to work with relatively thin wall cross-sections. The abovementioned angling is carried out for functionally advantageous orientation of the emptying nozzle. This already achieves advantageous proximity to the plane of the lateral wall of the housing, which is then followed, upon actuation, by the even further-reaching free-standing position. In order to achieve good covering of the space at the top of the dispenser, which accommodates the dispenser mechanism, it is also proposed that a downwardly directed apron extends from the angled portion of the emptying nozzle and reaches beyond the level of the pivot point. The region in which the handle is articulated is thus concealed from view. Finally, it is also proposed that, in the actuating position of the dispenser, the apron covers over a fold furrow of the squeeze head. The fold furrow as such, which is produced in the manner of a crescent moon in the delivery direction, acts, in particular, to facilitate actuation. This handling, at any rate, requires less force to be applied than in the case of the operation of compressing the dome-like squeeze head symmetrically from the apex.

BRIEF DESCRIPTION OF THE DRAWINGS

The subject matter of the invention is explained in more detail hereinbelow with reference to an exemplary embodiment illustrated in the drawings, in which.

DETAILED DESCRIPTION OF THE PREFERRED EMBODIMENT(S)

Figure 1:
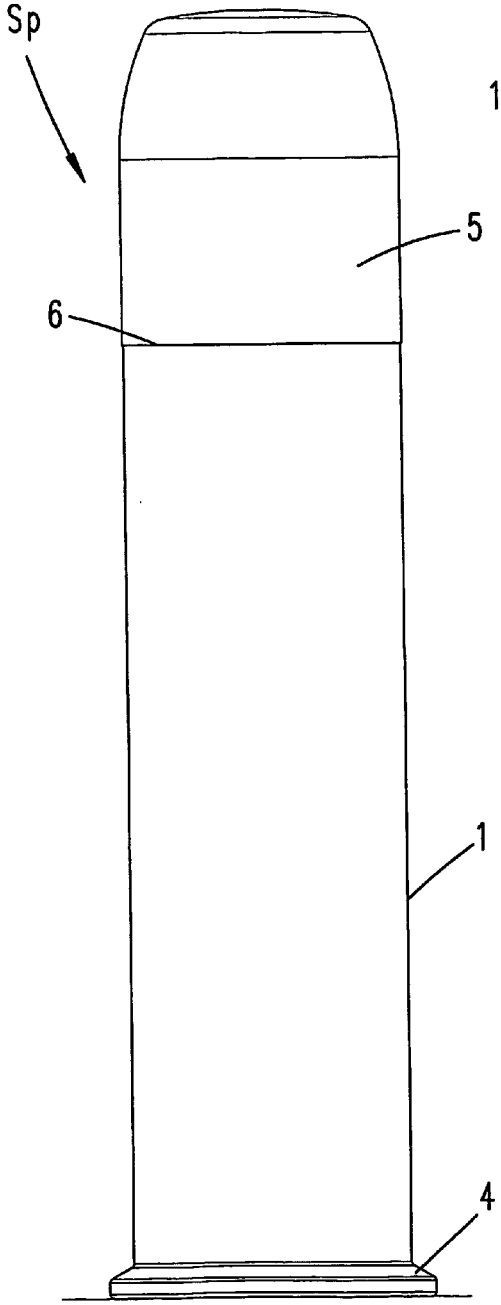
FIG. 1 shows, in side view, the dispenser realized as a stand-up unit, closed by a protective cap.
Figure 2:
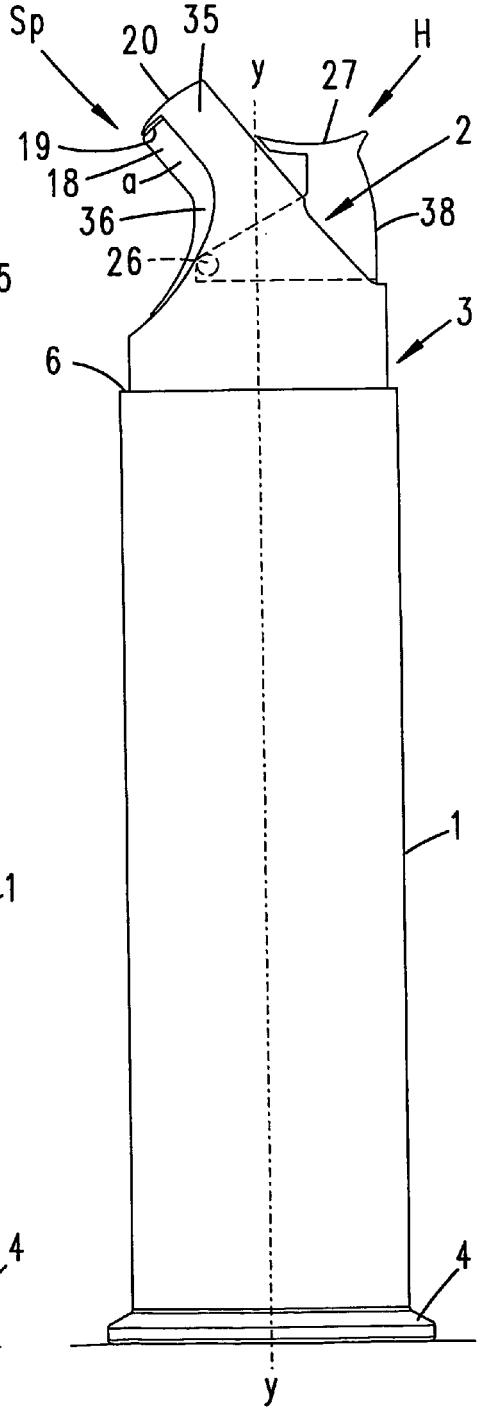
FIG. 2 shows an illustration like that in FIG. 1, but with the protective cap removed.
Figure 3:
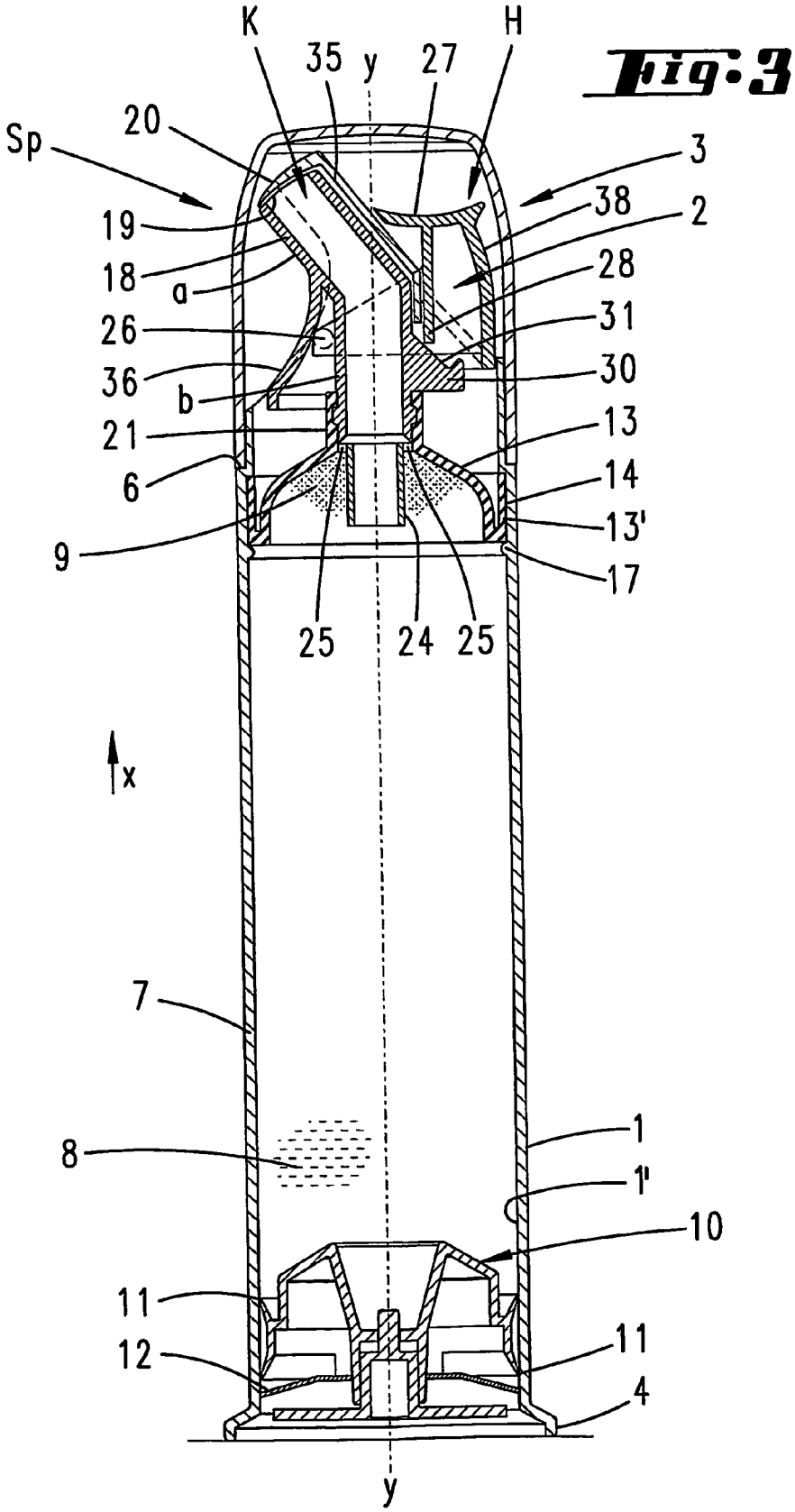
FIG. 3 shows a vertical section through the dispenser in the state of FIG. 1.

The dispenser Sp illustrated is realized as a stand-up unit. It has a tubular housing 1. The latter has, at the top, a dispenser head 3 containing the dispenser mechanism 2. A standing pedestal 4 is located at the bottom.

The dispenser head 3 can be covered by a protective cap 5 when the dispenser is not in use. It can be plugged on with a friction fit and is stop-limited against an annular shoulder 6, which is achieved by an offset in the wall of the cylindrical housing 1.

Most of the length of the volume of the housing 1 serves as a storage space 7 for accommodating pasty substance 8. This may be a main substance, for example toothpaste.

The pasty substance 8 then has a further pasty substance 9 applied over it. This further pasty substance is located in the dispenser head 3 and forms an additional substance, for example in the form of a mouthwash component. The latter is applied, in known manner, in strip form to an elongate portion of substance which is formed for apportioned delivery. The dispenser mechanism 2, in this respect, has a pump-like discharging action.

The lower termination of the storage space 7 is formed by a plunger 10. This is a follow-up plunger. It is inserted from beneath and thus simultaneously performs a cover function in respect of the storage chamber 7.

The plunger 10 is displaceable in a stepwise manner only in the emptying direction arrow x corresponding to the emptying actuation. In this case, peripheral lips 11 are guided along the cylindrical inner wall 1' of the housing 1.

On the side which is directed toward the standing pedestal 4, the plunger 10 carries a so-called clamping module 12. This has usually radially oriented spikes. Such a ring made of spring steel, moved into one plane, has a circumscribing diameter which is larger than the clear diameter of the cylindrical storage space 7. Accordingly, the sloping, slightly obliquely positioned spike ends dig, like supporting feet, into the inner wall 1' which, in this respect, is correspondingly capable of interlocking. This gives rise to a steeplejack-like action.

The core of the pump for the plunger 10 is formed by a dome-like squeeze head 13. The squeeze head 13, which is similar to a pump bellows, consists of elastomeric, resilient material. It is accommodated on the housing side in the transition region between storage space-7 and dispenser head 3, in a securing means 14 in the form of an annular groove. The upper termination 15 of the securing means 14 is achieved by the offset in the wall of the housing 1 there, which forms the annular shoulder 6; the lower termination 16, in contrast, is formed by a transversely convexly rounded annular rib 17. The pumping region of the squeeze head 13 is not incorporated in the securing means 14 itself. Rather, the securing means 14 is a cylindrical sleeve 13' which extends from the lower end periphery of the squeeze head and is turned over to stand freely in the emptying direction arrow x.

The operation of discharging the elongate portion of pasty substance 8/9 takes place via an emptying nozzle 18 consisting of relatively stiff material. The channel of the emptying nozzle is designated K. The emptying nozzle 18 is made up of an angled portion a, which can be placed in a freely projecting position, and a vertical portion b, which runs coaxially in relation to the longitudinal center axis y-y of the rotationally symmetrical dispenser Sp. The enclosed angle of inclination $\alpha$ is around 40°.

The opening cross-section 19, which forms a dispenser mouth, has a housing-mounted cover 20 gripping over it with closing action in the basic position of the dispenser Sp.

The other end of the emptying nozzle 18 is in plugging connection with the squeeze head 13, which can be pressed in in the direction of the plunger 10. The correspondingly pluggable end 18' of the portion b of the emptying nozzle 18, this portion running vertically in the basic position, is accommodated in a neck 21 of the squeeze head 13, this neck being located at the apex of the dome-like squeeze head 13. The lower end of the emptying nozzle 18 can be seen to be located in flush association with the said neck 21. A non-slip plug-in connection is present. For this purpose, use is made of annular bead 22 which is integrally formed at the lower end of the portion b, portion b running vertically in the basic position, and engages in a corresponding annular groove 23, located in the neck interior, for axial securing action.

The lower end 18' is then adjoined by a tube portion 24 which continues the delivery channel K of the emptying nozzle 18. The tube portion 24 divides up the flow of the so-called main substance, in this case pasty substance 8, from the additional substance which can be applied in strip form, in this case further pasty substance 9, which is located in the surroundings of the tube portion 24 and passes out as an elongate portion via feed windows 25. The device in this respect is known to a sufficient extent and will not be discussed in any more detail here.

The operation of pressing in the squeeze head 13, and thus discharging the pasty substance, takes place by actuation of a handle H realized in the form of a tilting lever. The handle is mounted such that it can be pivoted about a point 26. For this purpose, an accessibly located actuating contact surface 27 of the said handle H is subjected to a compressive force in the direction of the arrow P. The handle H is a single-armed lever of which the point 26, which forms a stationary articulation axis, in relation to the emptying nozzle 18 or longitudinal center axis y-y, is located on the opposite side to the actuating-button surface 27. In the drawing, the point 26 is located on the left-hand side, that is to say in the pivoting-out direction, of the said longitudinal center axis and the actuating contact surface 27 is located on the right-hand side of the same. The movement-transmission means of the handle H here act such that the emptying nozzle 18, upon handle actuation, pivots away sideways beneath the cover 20. As a result, the opening cross-section 19 of the emptying nozzle 18, this opening cross-section, even in the basic position, being located in the vicinity of the lateral-wall projection, is moved into an even more advantageous free-standing position, which even projects outwards beyond the lateral-wall projection. The elongate portion of substance which is to be discharged can thus be deposited in a specific manner, for example on a toothbrush.

The corresponding outward-tilting positioning takes place about an imaginary pivot point z, located approximately in the apex region of the, for all practical purposes, hemispherical squeeze head 13. In this case, an accompanying movement takes place in the direction of the plunger 10. The opening cross-section 19 is curved in relation to the pivot point z, as is the inner surface of the cover 20, which grips over the opening cross-section with closing action. This perfects the sealing closure. It is even possible to use an elevated surface, since the point z is capable of yielding movement.

In specific terms, the tilting or the pivoting-out movement of the emptying nozzle 18 via the handle H is achieved by means of a tail 28 which, in the basic position of the dispenser Sp, is oriented axially or parallel in space to the longitudinal center axis y-y. The lower, pressure-transmitting end surface 28' of the tail runs over an arcuate path 29, which is related radially to the point 26. This path intersects the pivot point z, depicted in FIGS. 4 and 5, in the basic position. The radius is designated R.

The tail 28 is directed toward a drive protrusion 30 of the emptying nozzle 18. The transversely projecting drive protrusion 30, which is rooted in the lateral wall of the portion b of the emptying nozzle 18, provides the tail 28 with an operating surface which crosses over the arcuate path steeply. The operating surface is embodied by a downwardly sloping oblique surface 31. The latter is preferably in directional alignment with the angled portion a of the emptying nozzle 18. The operating surface here need not be straight; a slight convex curvature or concave hollowing of the downwardly sloping oblique surface 31 likewise causes the emptying nozzle 18 to tilt.

Figure 5:
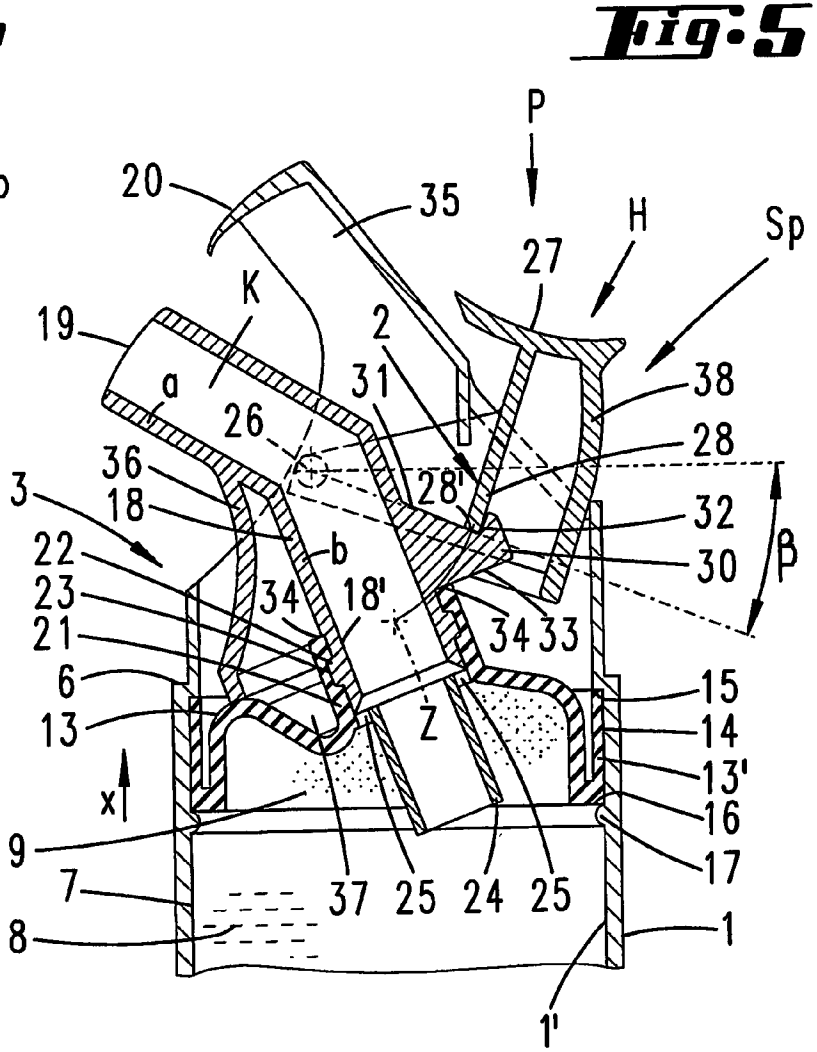
FIG. 5 shows the dispenser in the actuating position, represented merely partially in detail form as in FIG. 4.

As can be gathered from FIG. 5, the actuating position is stop-limited. For this purpose, the oblique surface 31 ends in a limiting groove 32.

In the basic position, the free end, that is to say the end surface 28', of the axially directed tail 28 is aligned approximately level with the pivot point 26, located on the tilting side. The pivoting displacement of the handle H which causes the pasty substance 8/9 to be discharged covers an angle β of approximately 20° (see FIG. 5).

The limiting groove 32 is formed by a nose-like, upwardly directed extension, the flank of which engages closely against the outside of the tail 28.

The bottom edge 33 of the drive protrusion 30, this bottom edge being horizontal in the basic position, runs in such a way that it is supported on the periphery 34 of the neck 21. The emptying nozzle 18 is thus additionally secured in the axial direction.

As far as the dispenser head 3 is concerned, it should also be explained that the cover 20 formed thereon forms the upper termination of a half-shell-like surround 35 of the angled portion a of the emptying nozzle 18. The surround 35 and portion a may be cross-sectionally configured such that the portion a is a cross-sectionally round tubelet and the U-leg-like portions of the surround 35 extend some way beyond the circular cross-section of the said tubelet. Such a surround 35 which extends beyond the equator may form a latching means for the purpose of securing the basic position of the dispenser Sp, for example during transportation.

Away from the base of the surround 35, the said portion a of the emptying nozzle 18 continues into an apron 36, which closes the accommodating space of the dispenser mechanism from there. This apron runs in the manner of part of a bell periphery. While performing its covering function, the apron 36 reaches beyond the level of the pivot point 26, which may be formed in physical terms by stub pins. It is possible for these stub pins to be of snap-in configuration.

In the actuating position of the dispenser Sp (see FIG. 5), the said apron 36, at the same time, covers a fold furrow 37 of the squeeze head 13.

The fold furrow 37 is produced as a result of the discharge zone of the squeeze head 13 of the dispenser there being folded in the tilting direction. The inward buckling is achieved particularly easily and results in smoother actuation than in cases in which the squeeze head 13 is collapsed via its center.

The squeeze head 13 functions as a restoring spring of the dispenser mechanism 2 in order to re-establish the basic position in each case.

Functioning is, to summarize briefly, as follows: by virtue of a compressive force being exerted in the direction of the arrow P, the handle H, which is configured as a tilting lever, displaces the emptying nozzle 18, via the tail 28 and the oblique surface 31, into an increasingly pivoted-out tilting position. The opening cross-section 19 thereby leaves the cover 20. At the same time, this results in compression of the pasty substance 8/9 due to the reduction in volume in the squeeze head 13. The substance, passing via the channel K of the emptying nozzle 18, is forced out in extruded portions.

Figure 4:
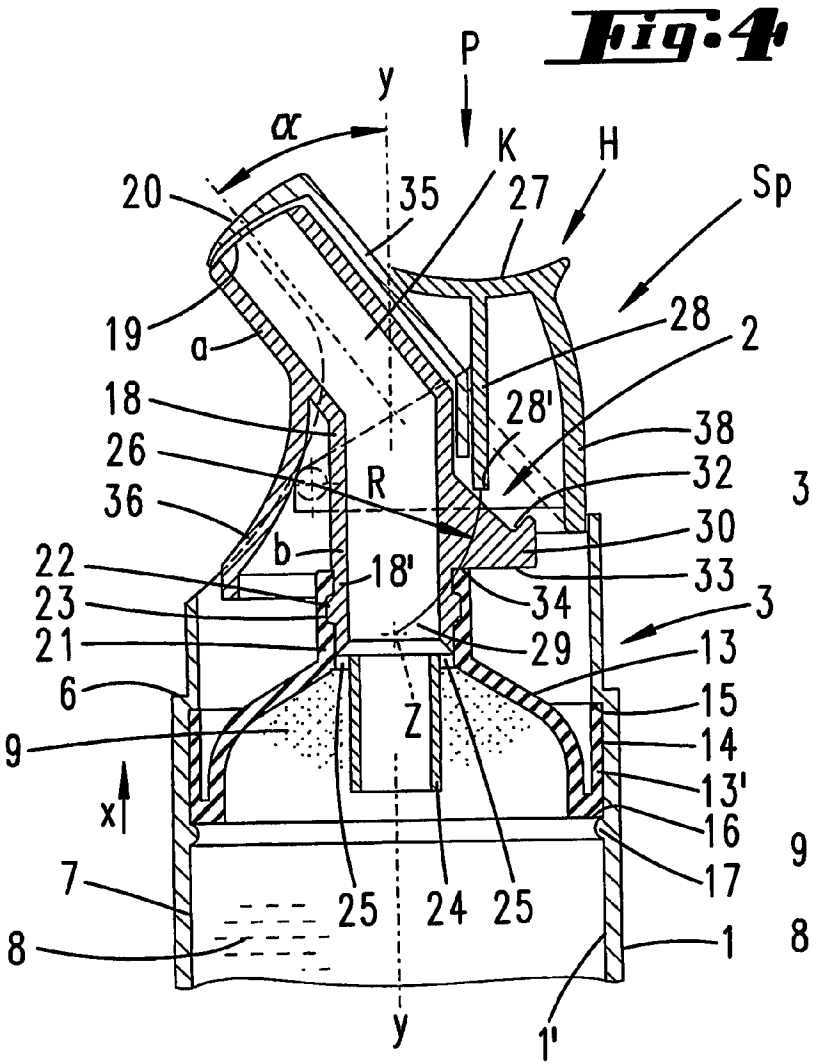
FIG. 4 shows the section according to FIG. 3 as an enlarged detail, showing the basic, ready-for-use position, that is to say with the protective cap removed.

When the handle H is released, the emptying nozzle 18, as a result of the restoring force of the squeeze head 13, returns into the basic position which can be seen from FIG. 4. As a result of the so-called self-closing effect, the plunger 10 is moved up by one step via the filling column of pasty substance 8/9. In the new plane, it locks against the cylindrical inner wall 1' via the abovedescribed clamping module 12. Any excess substance is sucked back behind the opening cross-section 19.

The handle has a hollowed contact surface 27. It continues, moreover, at the back into a cladding 38, which closes from there the space in which the dispenser mechanism is accommodated.

All features disclosed are (in themselves) pertinent to the invention. The disclosure content of the associated/attached priority documents (copy of the prior application) is hereby also included in full in the disclosure of the application, also for the purpose of incorporating features of these documents in claims of the present application.

What is claimed is:

1. Dispenser (Sp) for delivering portions of pasty substances (8/9), the dispenser comprising a tubular housing with a plunger, an emptying nozzle, a squeeze head, a handle and a stationary cover; wherein the plunger (10) is displaced in the tubular housing in a stepwise manner during emptying actuation in a direction (arrow x) of the emptying nozzle (18), which nozzle is associated with the squeeze head (13) that can be pressed in the direction of the plunger (10) and can be actuated via the handle (H); wherein the stationary cover (20) closes an opening cross-section (19) of the emptying nozzle, and the handle (H), upon pressure actuation (arrow P), pivots about a point (26) which, in relation to the emptying nozzle (18), is located on an opposite side to an actuating-button surface (27) of the handle, and the emptying nozzle (18) pivots away sideways beneath the cover (20).

2. Dispenser according to claim 1, wherein the handle has an axially directed tail (28) acting on a drive protrusion (30) of the emptying nozzle (18).

3. Dispenser according to claim 2, wherein an operating surface of the drive protrusion (30) is configured as a downwardly sloping oblique surface (31).

4. Dispenser according to claim 3, wherein the oblique surface (31) ends in a limiting groove (32).

5. Dispenser according to claim 2, wherein the free end of the axially directed tail (28) is located approximately level with the pivot point (26).

6. Dispenser according claim 1, wherein a lower end (18') of the emptying nozzle (18) is plugged in a flush manner into a neck (21) of the squeeze head (13).

7. Dispenser according to claim 3, wherein a bottom edge (33) of the drive protrusion (30) is supported on a periphery (34) of a neck (21) of the squeeze head (13).

8. Dispenser according to claim 1, wherein the cover (20) is seated on a half-shell-like surround (35) of an angled portion (a) of the emptying nozzle (18).

9. Dispenser according to claim 8, wherein a downwardly directed apron (36) extends from the angled portion (a) of the emptying nozzle (18) and reaches beyond the level of the pivot point (26).

10. Dispenser according to claim 9, wherein, in the actuating position, the apron (36) covers over a fold furrow (37) of the squeeze head (13).

* * * * *